US010157429B2

(12) United States Patent
Kardes et al.

(10) Patent No.: US 10,157,429 B2
(45) Date of Patent: Dec. 18, 2018

(54) FAST AND SCALABLE CONNECTED COMPONENT COMPUTATION

(71) Applicant: Intelius Inc., Bellevue, WA (US)

(72) Inventors: Hakan Kardes, Bellevue, WA (US); Siddharth Agrawal, Bellevue, WA (US); Xin Wang, Bellevue, WA (US); Ang Sun, Bellevue, WA (US)

(73) Assignee: PeopleConnect, Inc., Seattle, WA (US)

( * ) Notice: Subject to any disclaimer, the term of this patent is extended or adjusted under 35 U.S.C. 154(b) by 534 days.

(21) Appl. No.: 14/663,141

(22) Filed: Mar. 19, 2015

(65) Prior Publication Data

US 2015/0269230 A1 Sep. 24, 2015

Related U.S. Application Data

(60) Provisional application No. 61/955,344, filed on Mar. 19, 2014.

(51) Int. Cl.
*G06Q 50/00* (2012.01)

(52) U.S. Cl.
CPC ..... *G06Q 50/01* (2013.01)

(58) Field of Classification Search
CPC ..... G06F 17/30539; G06F 17/30958
USPC ..... 707/692
See application file for complete search history.

(56) References Cited

U.S. PATENT DOCUMENTS

2012/0278260 A1* 11/2012 Sauter et al. ..... 705/36 R
2013/0246315 A1 9/2013 Joshi et al.
2014/0215477 A1* 7/2014 Chen et al. ..... 718/102
2014/0330795 A1* 11/2014 Chavda et al. ..... 707/692

OTHER PUBLICATIONS

Aditya B. Patel et al., Addressing Big Data Problem Using Hadoop and Map Reduce, 2012, IEEE, 5 pages. (Year: 2012).*
Ashok, Powar Gayatri, et al., "A Clustering Based Hybrid Recommendation System for Services in Big Data," International Journal of Science and Research (IJSR), vol. 5, Issue 6, Jun. 2016, Paper ID: NOV164280, pp. 1911-1915.
Cabanes, Guénaël, et al., "A new topological clustering algorithm for interval data," Pattern Recognition, vol. 46, 2013, pp. 3030-3039.
Office Action dated Jul. 27, 2018, issued in related U.S. Appl. No. 14/663,174.
Chen, Xiao, et al., "Cloud-Scale Entity Resolution: Current State and Open Challenges," Open Journal of Big Data (OJBD), vol. 4, Issue 1, 2018, pp. 30-51.
James, Alex, et al., "Entity Resolution using Cloud Computing," Proceedings of SPIE, vol. 9499, 2015, pp. 94990S-1-M9490S-9.
(Continued)

*Primary Examiner* — Jean B Fleurantin
(74) *Attorney, Agent, or Firm* — Nixon & Vanderhye P.C.

(57) ABSTRACT

Finding connected components in a graph is a well-known problem in a wide variety of application areas such as social network analysis, data mining, image processing, and etc. We present an efficient and scalable approach to find all the connected components in a given graph. We compare our approach with the state-of-the-art on a real-world graph. We also demonstrate the viability of our approach on a massive graph with ~6B nodes and ~92B edges on an 80-node Hadoop cluster. To the best of our knowledge, this is the largest graph publicly used in such an experiment.

11 Claims, 7 Drawing Sheets

(56) References Cited

OTHER PUBLICATIONS

Kimmett, Ben, et al., "Fuzzy Joins in MapReduce: Edit and Jaccard Distance," 2016 7th International Conference on Information, Intelligence, Systems & Applications (IISA), 2016, 7 pages.
Liu, Qiaoling, et al., "CompanyDepot: Employer Name Normalization in the Online Recruitment Industry," KDD '16, 2016, 10 pages.
Liu, Qiaoling, et al., "Supporting Employer Name Normalization at both Entity and Cluster Level," KDD '17, 2017, pp. 1883-1892.
Talburt, John R., et al., "Entity Information Life Cycle for Big Data: Master Data Management and Information Integration," Chapter 10—CSRUD for Big Data, 2015, ISBN: 978-0-12-800537-8, pp. 161-190.
Yartseva, Lyudmila, "Alignment and Assembly: Inferring Networks from Noisy Observations," Thesis No. 7562, 2017, 123 pages.
Office Action dated Jan. 25, 2018, issued in related U.S. Appl. No. 14/663,174.
Bhattacharya, Indrajit, et al., "Entity Resolution in Graphs," Mining Graph Data, 2006, 21 pages.
Kirsten, Toralf, et al., "Data Partitioning for Parallel Entity Matching," arXiv preprint arXiv:1006.5309, 2010, 11 pages.
Kolb, Lars, et al., "Dedoop: Efficient Deduplication with Hadoop," Proceedings of the VLDB Endowment, vol. 5, No. 12, 2012, pp. 1878-1881.
Kolb, Lars, et al., "Load Balancing for MapReduce-based Entity Resolution," 2012 IEEE 28th International Conference on Data Engineering, 2012, pp. 618-629.
Kolb, Lars, et al., "Parallel Entity Resolution with Dedoop," Datenbank Spektrum, vol. 13, 2013, pp. 23-32.
Whang, Steven Euijong, et al., "Entity Resolution with Iterative Blocking," Proceedings of the 2009 ACM SIGMOD International Conference on Management of Data, ACM, 2009, 13 pages.
Kardes, Hakan, et al., "Graph-based Approaches for Organization Entity Resolution in MapReduce," Proceedings of the TextGraphs-8 Workshop, Oct. 18, 2013, pp. 70-78 (not "prior art").

* cited by examiner

```
CCF-Iterate
map(key, value)
   emit(key, value)
   emit(value, key)

reduce(key, < iterable > values)
   min ← key
   for each (value ∈ values)
      if(value < min)
         min ← value
      valueList.add(value)
   if(min < key)
      emit(key, min)
      for each (value ∈ valueList)
         if(min ≠ value)
            Counter.NewPair.increment(1)
            emit(value, min)
```

```
CCF-Iterate (w. secondary sorting)
map(key, value)
   emit(key, value)
   emit(value, key)

reduce(key, < iterable > values)
   minValue ← values.next()
   if(minValue < key)
      emit(key, minValue)
      for each (value ∈ values)
         Counter.NewPair.increment(1)
         emit(value, minValue)
```

Figure 3

```
CCF-Dedup
map(key, value)
   temp.entity1 ← key
   temp.entity2 ← value
   emit(temp, null)

reduce(key, < iterable > values)
   emit(key.entity1, key.entity2)
```

Figure 4

FAST AND SCALABLE CONNECTED COMPONENT COMPUTATION

CROSS-REFERENCE TO RELATED APPLICATIONS

This application claims the benefit of U.S. Provisional Application No. 61/955,344 filed Mar. 19, 2014, incorporated herein by reference.

STATEMENT REGARDING FEDERALLY SPONSORED RESEARCH OR DEVELOPMENT

None.

FIELD

The technology herein relates to graph mining and analysis and to record linkage using connected components.

BACKGROUND

Many systems such as proteins, chemical compounds, and the Internet can be modeled as a graph to understand local and global characteristics of the system. In many cases, the system under investigation is very large and the corresponding graph has a large number of nodes/edges requiring advanced processing approaches to efficiently derive information from the graph. Several graph mining techniques have been developed to extract information from the graph representation and analyze various features of the complex networks.

Finding connected components, disjoint subgraphs in which any two vertices are connected to each other by paths, is a very common way of extracting information from the graph in a wide variety of application areas ranging from analysis of coherent cliques in social networks, density based clustering, image segmentation, data base queries and many more.

Record linkage, the task of identifying which records in a database refer to the same entity, is also one of the major application areas of connected components. Finding connected components within a graph is a well-known problem and has a long research history. However, the scale of the data has grown tremendously in recent years. Many online networks such as Facebook, LinkedIn, and Twitter, have 100's of millions of users and many more connections among these users. Similarly, several online people search engines collect billions of records about people, and try to cluster these records after computing the similarity scores between these records. Analysis of such massive graphs requires new technology.

Recently, several MapReduce approaches have been developed to find the connected components in a graph. In spite of the fact that the basic ideas behind these approaches have similarities such as representing each connected component with the smallest node id, there are some differences in how they implement their ideas.

PEGASUS is a graph mining system where several graph algorithms including connected component computation are represented and implemented as repeated matrix-vector multiplications. Other approaches have O(d) bound on the MapReduce iterations needed where d is the diameter of the largest connected component. Still other approaches focus on reducing the boundaries of the number of map-reduce iterations needed and provide algorithms with lower bounds (e.g., 3 log d). On the other hand, some others analyze several real networks and show that real networks have small diameters in general. Such improvements might not help much in real networks where the diameters are small.

The disclosed non-limiting embodiments herein provide a connected component computation strategy used in the record linkage process of a major commercial People Search Engine to deploy a massive database of personal information.

BRIEF DESCRIPTION OF THE DRAWINGS

The following detailed description of exemplary non-limiting illustrative embodiments is to be read in conjunction with the drawings of which:

FIG. 3 shows example non-limiting CCF-Iterate pseudocode with Secondary Sorting;

FIG. 4 shows example non-limiting CCF-Dedup pseudocode;

DETAILED DESCRIPTION OF EXAMPLE NON-LIMITING EMBODIMENTS

Figure 1A:
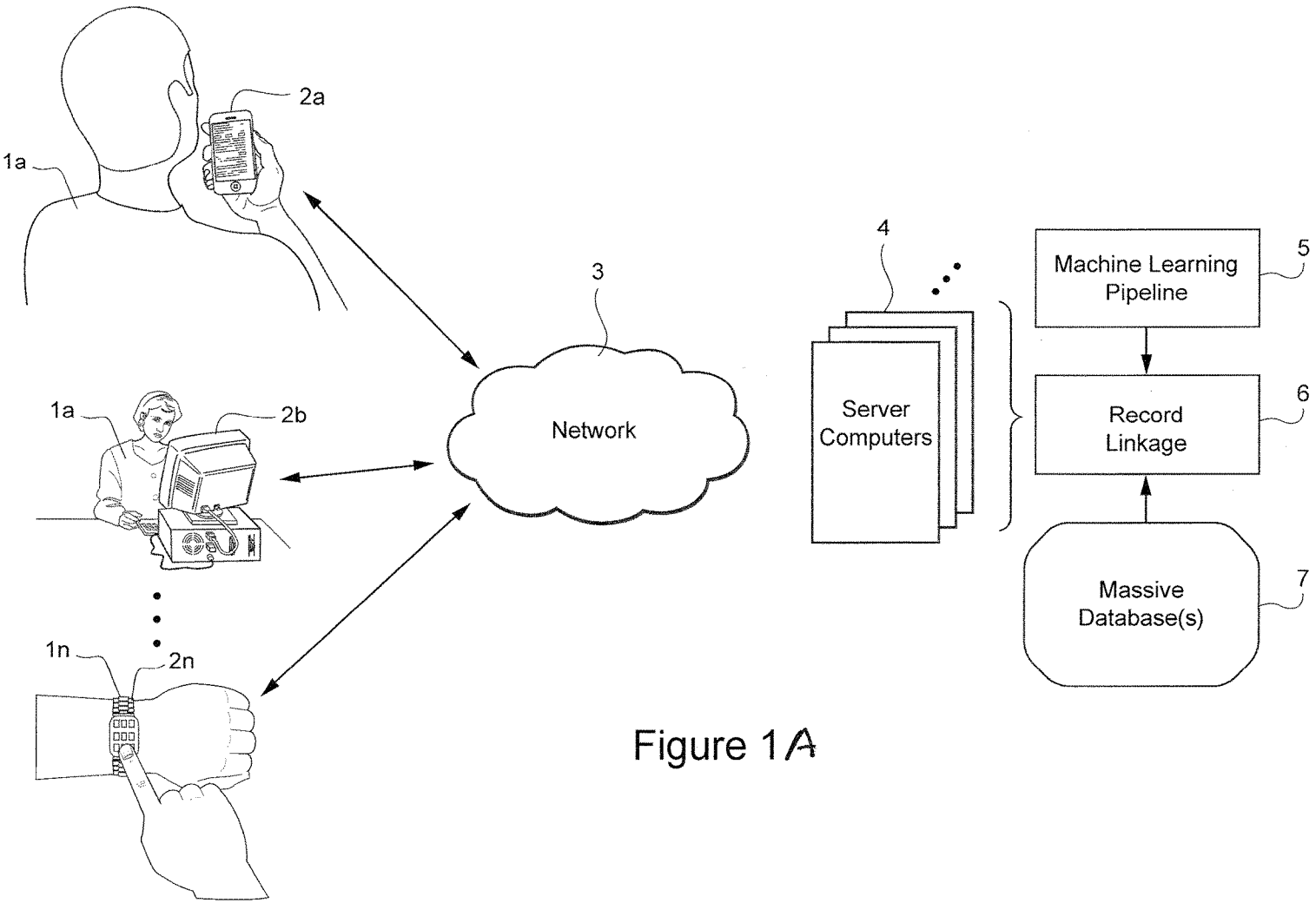
FIG. 1A shows an example non-limiting overall system.

FIG. 1A shows an example non-limiting data analysis and retrieval system. In the example shown, users 1*a*, 1*b*, . . . , 1*n* use network connected computer devices 2*a*-2*n* (e.g., smart phones, personal computers, wearable computers, etc.) to access servers 4 via a network(s) 3. Such user devices 2*a*-2*n* can comprise any type (e.g., wired or wireless) of electronic device capable of accessing and presenting data via a display or otherwise. In the example shown, the devices 2*a*-2*n* that users 1*a*, 1*b*, . . . 1*n* operate may for example include resident applications, internet browsers or both that are capable of conveying searches and other queries inputted by the users to the server computers 4, and provide server responses back to the user devices for display or other presentation.

As one example, suppose a user 1*a* wants to determine current contact, employment and other information for Josie Hendricks who works for Microsoft. The user 1*a* can input "Josie Hendricks" into search fields displayed by his device 2*a*, audibly request his device to search for "Josie Hendricks", or otherwise input his search query. His user device 2*a* may include one or more processors, memory devices, input devices, output devices and other conventional components that create an electronic search query and transmit the query electronically via network 3 to the server computers 4 using http or other known protocol. The server computers 4 in turn query a potentially massive database(s) 7 in real time to determine whether one or more records exists for "Josie Hendricks" and whether they are linked with any organizations. The server computers 4 (which may comprise conventional processors, memory devices, network adapters and other components) search the database 7 to locate records that are relevant to the user's search query. If such records are found, the server computers 4 may respond by retrieving located information from database(s) 7 and transmitting the information to the user's device 2*a* via network 3. Such transmitted information could inform the user that Josie works for Microsoft or a particular Microsoft entity.

Example Record Linkage Pipeline Training

Figure 1B:
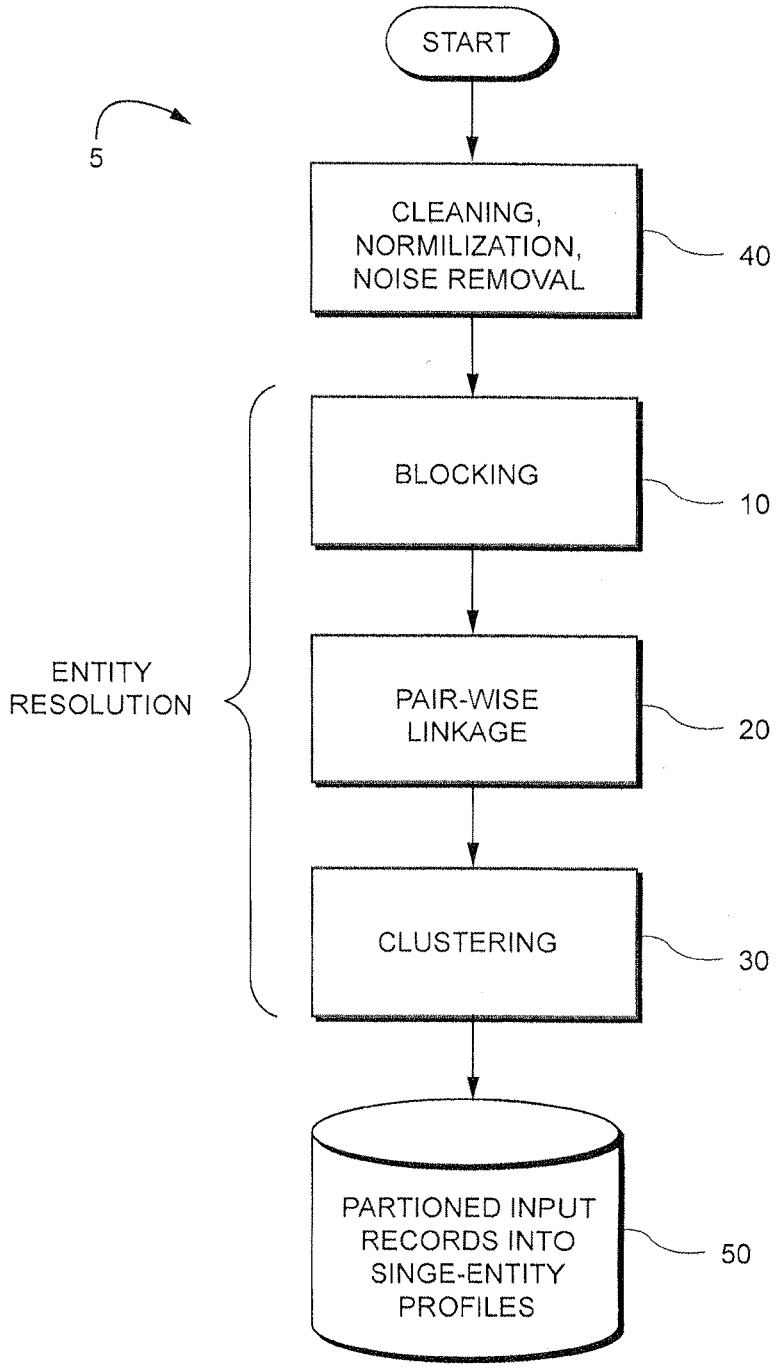
FIG. 1B shows an example non-limiting record linkage pipeline.

To perform the above in real time, the example non-limiting embodiment trains a model as shown in FIG. 1B. An example non-limiting process starts by collecting billions of personal records from three sources of U.S. personal records. The first source is derived from US government records, such as marriage, divorce and death records. The second is derived from publicly available web profiles, such as professional and social network public profiles. The third type is derived from commercial sources, such as financial and property reports (e.g., information made public after buying a house). Example fields on these records might include name, address, birthday, phone number, (encrypted) social security number, job title, and university attended. Note that different records will include different subsets of these example fields.

After collection and categorization, the Record Linkage process should link together all records belonging to the same real-world person. That is, this process should turn billions of input records into a few hundred million clusters of records (or profiles), where each cluster is uniquely associated with a single real-world U.S. resident.

Figure 1C:
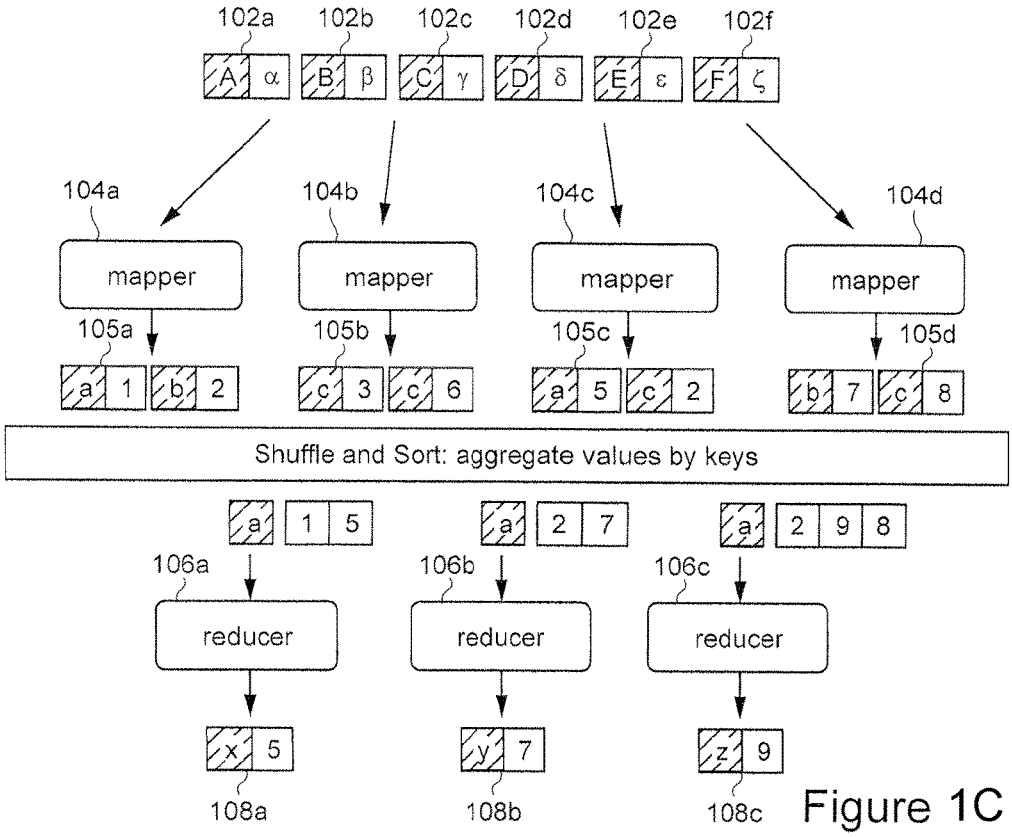
FIG. 1C shows an example non-limiting MapReduce implementation.
Figure 1D:
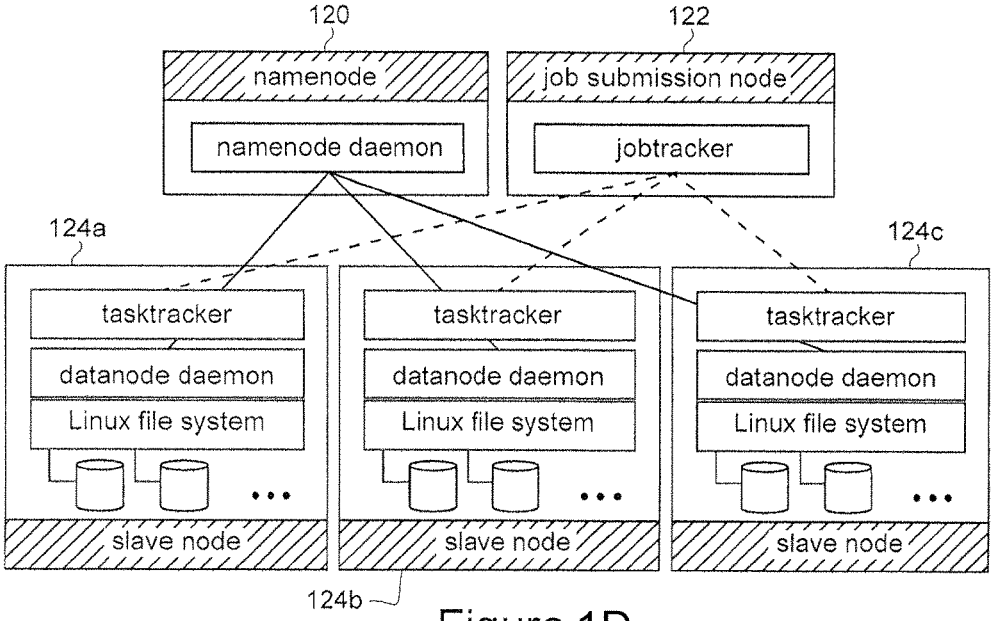
FIG. 1D shows an example non-limiting Hadoop implementation.

Our example non-limiting system shown in FIG. 1D follows the standard high-level structure of a record linkage pipeline by being divided into four major components: 1) data cleaning 40; 2) blocking 10; 3) pair-wise linkage 20; and 4) clustering 30.

First, all records go through a cleaning process 40 that starts with the removal of bogus, junk and spam records. Then all records are normalized to an approximately common representation. Finally, all major noise types and inconsistencies are addressed, such as empty/bogus fields, field duplication, outlier values and encoding issues. At this point, all records are ready for subsequent stages of Record Linkage. The blocking 10 groups records by shared properties to determine which pairs of records should be examined by the pairwise linker as potential duplicates. Next, the linkage 20 assigns a score to pairs of records inside each block using a high precision machine learning model whose implementation is described in detail in S. Chen, A. Borthwick, and V. Carvalho, "The case for cost-sensitive and easy-to-interpret models in industrial record linkage", 9th International Workshop on Quality in Databases (ACM Aug. 29, 2011) and U.S. Patent Publication No. 2012/0278263. If a pair scores above a user-defined threshold, the records are presumed to represent the same person.

The clustering 30 first combines record pairs into connected components, which is a focus of this disclosure, and then further partitions each connected component to remove inconsistent pair-wise links. Hence at the end of the entire record linkage process, the system has partitioned the billions of input records into disjoint sets called profiles, where each profile corresponds to a single person or other entity.

The processing of such enormous data volumes can be advantageously performed on highly scalable parallelized processes. This is possible with distributed computing. The need to distribute the work informs the design. Our non-limiting embodiment provides a process and system for finding connected components which is based on the MapReduce programming model and may be implemented using Hadoop.

Example Non-Limiting MapReduce Implementation

The processing of large data volumes benefits from a highly scalable parallelized process which distributed computing can provide. In this example non-limiting implementation, it is possible to use the conventional MapReduce computing framework (see FIG. 1C) to provide such scaleability. For example, both the CCF-Iterate and CCF-Dedup tasks of FIG. 1E may be implemented as a series of Hadoop or other MapReduce jobs written in Java.

Generally speaking, MapReduce is a standard distributed computing framework that provides an abstraction that hides many system-level details from the programmer. This allows a developer to focus on what computations need to be performed, as opposed to how those computations are actually carried out or how to get the data to the processes that depend on them. MapReduce thus provides a means to distribute computation without burdening the programmer with details of distributed computing. See Lin et al., Data-Intensive Text Processing with MapReduce, Synthesis Lectures on Human Language Technologies ((Morgan and Claypool Publishers 2010), incorporated herein by reference. However, as explained below, alternative implementations are also possible and encompassed within the scope of this disclosure.

As is well known, MapReduce divides computing tasks into a map phase in which the input, which is given as (key,value) pairs, is split up among multiple machines to be worked on in parallel; and a reduce phase in which the output of the map phase is put back together for each key to independently process the values for each key in parallel. Such a MapReduce execution framework coordinates the map and reduce phases of processing over large amounts of data on large clusters of commodity machines. MapReduce thus codifies a generic "recipe" for processing large data sets that consists of those two stages.

Referring now more particularly to the FIG. 1C diagram of an example MapReduce implementation, in the first, or "mapping" stage 104, a user-specified computation is applied over all input records in a data set. These operations occur in parallel with intermediate output that is then aggregated by another user-specified reducer computation 106. The associated execution framework coordinates the actual processing.

Thus, as shown in FIG. 1C, MapReduce divides computing tasks into a map or mapper phase 104 in which the job is split up among multiple machines to be worked on in parallel, and a reducer phase 106 in which the outputs of the map phases 104 are put back together. The map phase 104 thus provides a concise way to represent the transformation of a data set, and the reduce phase 106 provides an aggregation operation. Moreover, in a MapReduce context, recursion becomes iteration.

In this FIG. 1C example, key data pairs 102 form the basic data structure. Keys and values may be primitives such as integers, floating point values, strings and raw bytes, or they may be arbitrarily complex structures (lists, tuples, associative arrays, etc.). Programmers may define their own custom data types, although a number of standard libraries are available to simplify this task. MapReduce processes involve imposing the key-value structure on arbitrary data sets. In MapReduce, the programmer defines a mapper and a reducer with the following signatures:

map:(k1,v1)→[(k2,v2)]

reduce:(k2,[v2])→[(k3,v3)]

where [ . . . ] denotes a list.

The input to processing starts as data stored in an underlying distributed file system. The mapper 104 is applied to every input key-value pair 102 (split across an arbitrary number of files) to generate an arbitrary number of intermediate key-value pairs. The reducer 106 is applied to all values associated with the same intermediate key to generate output key-value pairs 108. Output key-value pairs from each reducer 106 are written persistently back onto the distributed file system to provide r files where r is the number of reducers. Thus, mappers 104 are applied to all input key-value pairs 102, which generate an arbitrary number of intermediate key-value pairs 105. Reducers 106 are applied to all values associated with the same key. Between the map and reduce phases lies a barrier 110 that involves a large distributed sort and group by.

Example Non-Limiting Hadoop Cluster Architecture Distributed Computing Platform

MapReduce can be implemented using a variety of different distributed execution frameworks such as the open-source Hadoop implementation in Java, a proprietary implementation such as used by Google, a multi-core processor implementation, a GPGPU distributed implementation, the CELL architecture, and many others. High performance computing and conventional cluster architectures can provide storage as a distinct and separate component from computation. In a Hadoop implementation, reducers 106 are presented with a key and an iterator over all values associated with a particular key, where the values are arbitrarily ordered.

The MapReduce distributed file system is specifically adapted to large-data processing workloads by dividing user data into blocks and replicating those blocks across the local discs of nodes in the computing cluster. The distributed file system adopts a master-slave architecture in which the master maintains the file name space (metadata, directory structure, file to block mapping, location of blocks, and access permissions) and the slaves manage the actual data blocks. Such functionality includes name space management, coordinating file operations, maintaining overall health of the file system, and other functions. Hadoop is a mature and accessible implementation, and is therefore convenient for exposition here. Of course, nothing is this example non-limiting implementation is limited to MapReduce or Hadoop per se. Rather, any non-limiting detailed design using distributed computer environments or other parallel processing arrangements could be used.

FIG. 1D shows one example implementation Hadoop cluster architecture which consists of three separate components: name node 120, job submission node 122 and many slave nodes 124. Name node 120 runs a name node daemon. The job submission node 122 runs the job tracker, which is the single point of contact for a client wishing to execute a MapReduce job. The job tracker monitors the progress of running MapReduce jobs and is responsible for coordinating the execution of the mappers and reducers 104, 106.

The bulk of the Hadoop cluster consists of slave nodes 124 that run both a task tracker (responsible for actually running user code) and a data node daemon (for serving HDFS data). In this implementation, a Hadoop MapReduce job is divided up into a number of map tasks and reduce tasks. Task trackers periodically send heartbeat messages to the job tracker that also double as a vehicle for task allocation. If the task tracker is available to run tasks, the return acknowledgement of the task tracker heartbeat contains task allocation information. The number of reduce tasks is equal to the number of reducers 106. The number of map tasks, on the other hand, depends on many factors: the number of mappers specified by the programmer, the number of input files and the number of HDFS data blocks occupied by those files.

Each map task 104 is assigned a sequence of input key value pairs 102 which are computed automatically. The execution framework aligns them to HDFS block boundaries so that each map task is associated with a single data block. The job tracker tries to take advantage of data locality—if possible, map tasks are scheduled on the slave node that codes the input split so that the mapper will be processing local data. If it is not possible to run a map task on local data, it becomes necessary to stream input key-value pairs across the network.

In the Hadoop implementation, mappers 104 are Java objects with a MAP method among others. A mapper object is instantiated for every map task by the task tracker. Life cycle of this object begins with instantiation where a hook is provided in the API to run programmer-specified code. This means that mappers can read inside data, providing an opportunity to load static data sources, dictionaries and the like. After initialization, the MAP method is called by the execution framework on all key-value pairs in the input split. Since these method calls occur in the context of the same Java object, it is possible to preserve state across multiple key-value pairs within the same map task. After all key-value pairs in the input split have been processed, the mapper object provides an opportunity to run programmer-specified termination code.

The execution of the reducers is similar to that of the mappers. Each reducer object is instantiated for every reduce task 106. The Hadoop API provides hooks for programmer-specified initialization and termination code. After initialization, for each intermediate key in the partition, the execution framework repeatedly calls the REDUCE method with an intermediate key and an iterator over all values associated with that key. The programming model guarantees that intermediate keys will be presented to the reduce method in sorted order. Since this occurs in the context of a single object, it is possible to preserve state across multiple intermediate keys in associated values within a single reduce task.

Example Detailed Processing for Finding Connected Components

Our non-limiting embodiment for finding connected components in a given graph uses the above-described MapReduce framework. We also make use of the Hadoop implementation of the MapReduce computing framework, and the technology described here can be implemented as a series of Hadoop jobs written in Java. Moreover, in a MapReduce context, recursion becomes iteration.

The following is a formal definition of connected components in graph theory context. Let G=(V, E) be an undirected graph where V is the set of vertices and E is the set of edges. $C=(C_1, C_2, \ldots, C_n)$ is the set of disjoint connected components in this graph where $(C_1 \cup C_2 \cup \ldots \cup C_n = V$ and $(C_1 \cap C_2 \cap \ldots \cap C_n) = \emptyset$. For each connected component $C_i \in C$, there exists a path in G between any two vertices $v_k$ and $v_l$ where $(v_k, v_l) \in C_i$. Additionally, for any distinct connected component $(C_i, C_j) \in C$, there is no path between any pair $v_k$ and $v_l$ where $v_k \in C_i$, $v_l \in C_j$. Thus, problem of finding all connected components in a graph is finding the C satisfying the above conditions.

Figures 1E, 2:
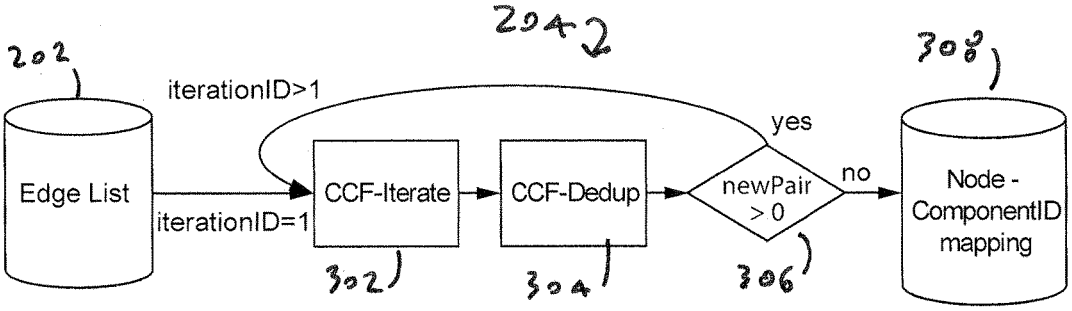
FIG. 1E shows an example non-limiting Connected Component Finder (CCF) Module.
FIG. 2 shows example non-limiting CCF-Iterate pseudocode.
Figure 5A:
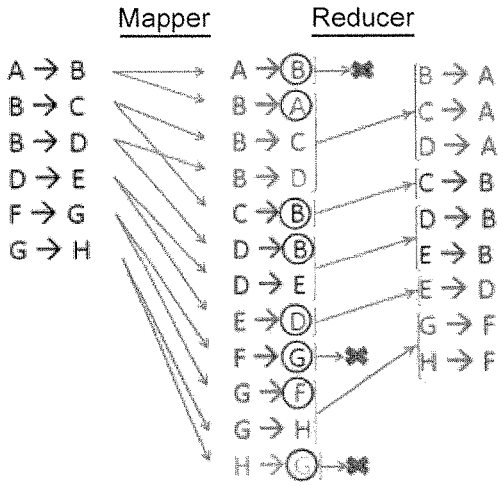
FIGS. 5A-5D show example non-limiting mapper and reducer implementations.
Figure 5B:
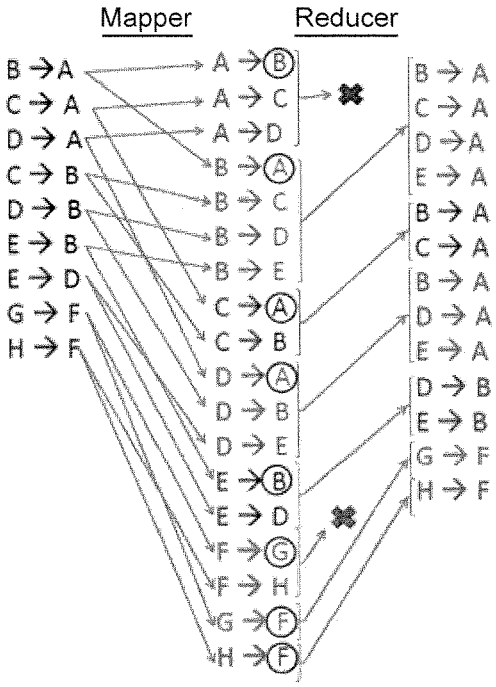
Figure 5C:
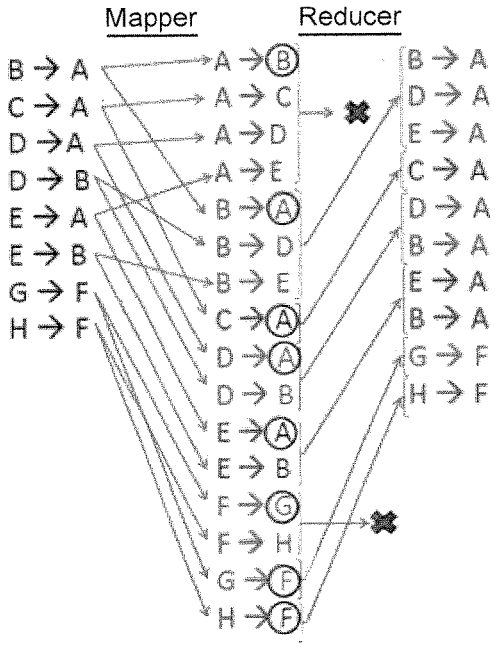
Figure 5D:
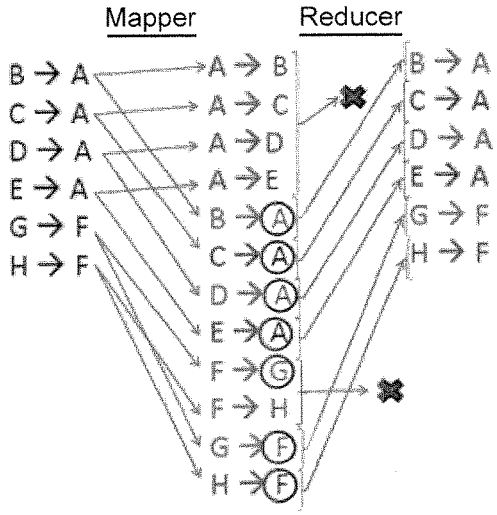

In order to find the connected components in a graph, we developed the Connected Component Finder (CCF) module 204 shown in FIG. 1E. The input 202 to the module is the list of all the edges in the graph. As an output 308 from the module, what we want to obtain is the mapping from each node in the graph to its corresponding componentID. For simplicity, we use the smallest node id in each connected component as the identifier of that component. Thus, the module should output a mapping table from each node in the graph to the smallest node id in its corresponding connected component. To this end, we designed a chain of two MapReduce jobs, namely, CCF-Iterate 302, and CCF-Dedup 304, that will run iteratively until we find the corresponding componentIDs for all the nodes in the graph.

CCF-Iterate 302 job generates adjacency lists AL= $a_1, a_2, \ldots, a_n$) for each node v, and if the node id of this node $v_{id}$ is larger than the min node id $a_{min}$ in the adjacency list, it first creates a pair ($v_{id}$, $a_{min}$) and then a pair for each ($a_i$, $a_{min}$) where $a_i \in AL$, and $a_i \neq a_{min}$. If there is only one node in AL, it means we will generate the pair that we have in previous iteration. However, if there is more than one node in AL, it means we might generate a pair that we didn't have in the previous iteration, and one more iteration is needed. Please note that, if $v_{id}$ is smaller than $a_{min}$, we do not emit any pair.

Example pseudo code for CCF-Iterate 302 is given in FIG. 2. For the first iteration, this job takes the initial edge list as input. In later iterations, the input is the output of CCF-Dedup 304 from the previous iteration. We will represent the key and value pairs in the MapReduce framework as <key; value>. We first start with the initial edge list to construct the first degree neighborhood of each node. To this end, for each edge <a; b>, the mapper emits both <a; b>, and <b; a> pairs so that a should be in the adjacency list of b and vice versa. In a reduce phase, all the adjacent nodes will be grouped together for each node. We first go over all the values to find the minValue and store all the values in a list. If the minValue is larger than key, we do not emit anything. Otherwise, we first emit the <key; minValue> pair. Next, we emit a pair for all other values as <value; minValue>, and increase the global NewPair counter by 1. If the counter is 0 at the end of the job, it means that we found all the components and there is no need for further iterations.

Adjusting memory utilization is useful while developing tools/services to run in the cloud as high memory machines are much more expensive. In MapReduce, values can be iterated just once without loading all of them into memory. If multiple passes are needed, the values should be stored in a list. Reducers don't receive the values in a sorted order. Hence, CCF-Iterate 302 in FIG. 2 iterates over the values twice. A first iteration is for finding the minValue, the second iteration is for emitting the necessary pairs. The space complexity of this approach is O(N) where N is the size of largest connected component as we store the values in a list in the reducer.

In order to improve the space complexity further, we implemented another version of CCF-Iterate 302, presented in FIG. 3. A secondary sort approach can be used to pass the values to the reducer in a sorted way with custom partitioning. See J. Lin et al. cited above. We don't need to iterate over the values with this approach as the first value will be the minValue. We will just iterate over the values once to emit the necessary values. During our experiments, the run-time performance of these two approaches were very close to each other when the size of the largest component is relatively small (i.e., up to 50K nodes). However, when there are connected components with millions of nodes, the second approach is much more efficient.

During the CCF-Iterate 302 job, the same pair might be emitted multiple times. The second job, CCF-Dedup 304, deduplicates the output of the CCF-Iterate job. This job increases the efficiency of CCF-Iterate 302 job in terms of both speed and I/O overhead. Example pseudo code for this job is given in FIG. 4.

We illustrate our approach on an example set of edges in FIG. 5. In this example, there are 6 edges in the graph, and we iteratively find the connected components. FIG. 5-(*a*), (*b*),(*c*), and (*d*) represent the interated CCF-Iterate 302 jobs. Since CCF-Dedup 304 job just deduplicates the CCF-Iterate output, it is not illustrated in the figure. For example, in the output of second iteration in FIG. 5-(*b*), there are duplicates of <B; A>, <C; A>, <D; A>, and <E; A>. However, the duplicates are removed by the CCF-Dedup 304 job and are not illustrated in the input of third iteration in FIG. 5. The min value for each reduce group is represented with a circle. The number of NewPairs found in each iteration are 4, 9, 6, and 0, respectively. Thus, we stop after the fourth iteration as all the connected components are found.

Worst case scenario for the number of necessary iterations is d+1 where d is the diameter of the network. The worst case happens when the min node in the largest connected component is an end-point of the largest shortest-path. The best case scenario takes d/2+1 iterations. For the best case, the min node should be at the center of the largest shortest-path.

Examples

We ran the experiments on a Hadoop cluster consisting of 80 nodes, each with 8 cores. There are 10 mappers, and 6 reducers available at each node. We also allocated 3 GB memory for each map/reduce task.

We used two different real-world datasets for our experiments. The first one is a web graph (Web-google) which was released in 2002 by Google as a part of Google Programming Contest. This dataset can be found at http://snap.stanford.edu/data/web-Google.html. There are 875K nodes and 5.1 M edges in this graph. Nodes represent web pages and directed edges represent hyperlinks between them. We used this dataset to compare the run-time performance of our approach with that of Pegasus and CC-MR. Table 1 presents the number of iterations and total run-time for the PEGASUS, CC-MR, and our CCF methods. CC-MR took the least number of iterations, while PEGASUS took the most number of iterations. PEGASUS also took the longest amount of time to finish. Even though our CCF approach took 3 more iterations than the CC-MR approach, the run-time performance times are very close to each other. In the MapReduce framework, each map/reduce task has some initialization period. The run-time difference between CC-MR and CCF is mainly due to the initialization periods as CCF took 3 more iterations. In larger graphs with billions nodes and edges, the effect of initialization is negligible.

TABLE 1

Performance Comparison

| | # of Iterations | Run Time (Sec) |
|---|---|---|
| PEGASUS | 16 | 2403 |
| CC-MR | 8 | 224 |
| CCF (US) | 11 | 256 |

Figure 6:
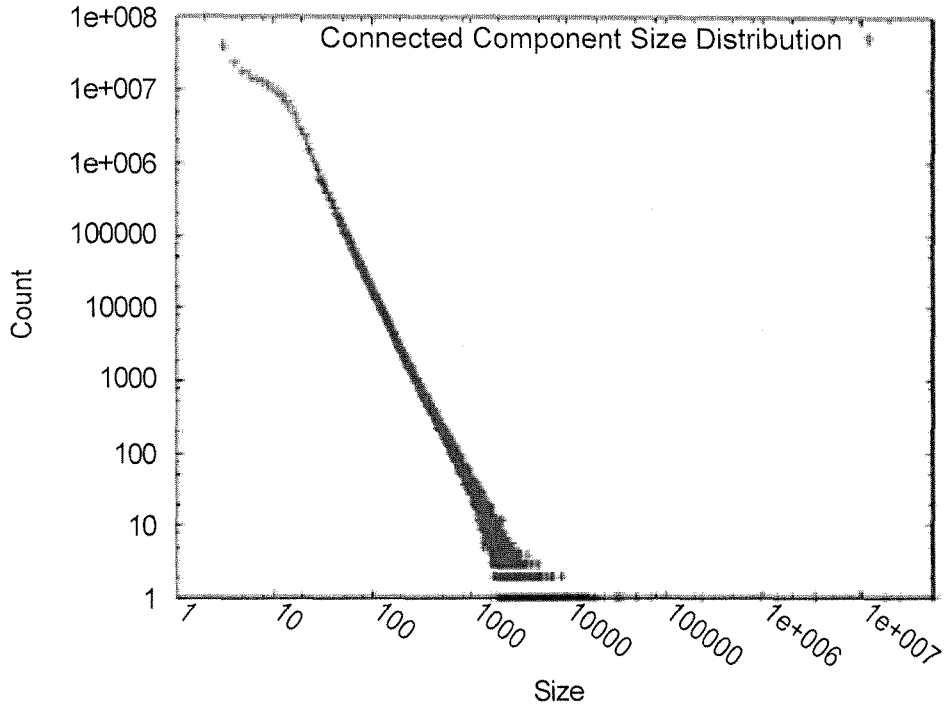
FIG. 6 shows an example non-limiting Connected Component Size Distribution.

We also used a second dataset which has around 6 billion public people records and 92 B pairwise similarity scores among these records to demonstrate the viability of our approach for very large data sets. We got several errors when trying to use Pegasus and CC-MR for this dataset. These approaches might be implemented with the assumption that each node id will be an integer. However, when there are 6 B nodes in the graph, integer space is not enough to represent all of the nodes. Please note that this an assumption and the actual reason might be different. Our CCF approach found all of the connected components in this graph in 7 hours and 13 iterations. The diameter of this graph was 21. Our CCF approach found 435 M connected components in this graph. The largest three connected components contain 53, 25, and 17 million nodes, respectively. The size distribution of all the connected components in this graph is given in FIG. 6.

In this disclosure, we presented a novel Connected Component Finder (CCF) approach for efficiently finding all of the connected components in a graph. We have implemented this algorithm in the MapReduce framework with low memory requirements so that it may scale to the graphs with billions of nodes and edges. We used two different real-world datasets in our experiments. We first compared our approach with the PEGASUS and CC-MR methods on a web graph (Web-google). While our approach outperformed PEGASUS in terms of total run time, CC-MR approach performed slightly better than our approach. However, the main reason for that was the initialization overhead of map/reduce tasks. Next, we demonstrated the viability of our approach on a massive graph with ~6 B nodes and ~92 B edges on an 80-node Hadoop cluster. Due to their limitations, we were not able to run the other approaches with this graph. To the best of our knowledge, this is the largest graph publicly used in such an experiment.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A data processing system for finding connected components in a graph comprising:

an input device that receives a list of edges in the graph; and a distributed processing arrangement coupled to the input device, the distributed processing arrangement including a plurality of processors operatively coupled to at least one memory that execute, in a distributed fashion, an iterative map and reduce process that generates adjacency for nodes in the graph;

wherein the distributed processing arrangement is configured to map connected components in the graph without storing the entire connected components in the at least one memory, wherein the distributed processing arrangement uses the smallest node identifier in each connected component as the identifier of that component and the output comprises a mapping table from each node in the graph to the smallest node ID in the corresponding connected component.

2. The system of claim 1 wherein the distributed processing arrangement comprises MapReduce.

3. The system of claim 1 wherein the distributed processing arrangement comprises Hadoop.

4. The system of claim 1 wherein the distributed processing arrangement chains the iterative generation of adjacency and the deduplication so that both run iteratively until the corresponding component identifiers for all nodes in the graph are found.

5. The system of claim 1 wherein the distributed processing arrangement passes values to be deduplicated in a sorted way with custom partitioning.

6. The system of claim 1 wherein the distributed processing arrangement finds all connected components in the graph without loading all of said connected components into the memory for simultaneous storage in the memory.

7. The system of claim 1 wherein the distributed processing arrangement is configured to apply mappers to all input key-value pairs to generate an arbitrary number of intermediate key-value pairs, and apply reducers to all values associated with the same key.

8. The system of claim 7 wherein the distributed processing arrangement is configured to write output key-value pairs from each reducer stage into a distributed file system to provide r files where r is the number of reducers.

9. The system of claim 1 wherein the distributed processing arrangement is configured to assign each map task a sequence of input key value pairs.

10. The system of claim 1 wherein the distributed processing arrangement is configured to supply reducers with values in an unsorted order.

11. The system of claim 1 wherein the distributed processing arrangement is configured to iterate values just once without loading all of the iterate values into the at least one memory.

* * * * *